United States Patent [19]
Binger
[11] 4,365,483
[45] Dec. 28, 1982

[54] VERTICAL CONVECTION HEAT DISSIPATION TOWER

[76] Inventor: Larry W. Binger, P.O. Box 32511, San Antonio, Tex. 78216

[21] Appl. No.: 279,339

[22] Filed: Jul. 1, 1981

[51] Int. Cl.³ ..... F25B 39/04

[52] U.S. Cl. ..... 62/183; 62/238.6; 62/305; 62/506

[58] Field of Search ..... 62/183, 305, 506, 238.6

[56] References Cited

U.S. PATENT DOCUMENTS 3,177,929 4/1965 Jennings ..... 62/183 X
3,545,228 12/1970 Dinger et al. ..... 62/506
3,908,393 9/1975 Eubank ..... 62/506 X
3,979,923 9/1976 Jennings ..... 62/305 X

*Primary Examiner*—Lloyd L. King
*Attorney, Agent, or Firm*—Gunn, Lee & Jackson

[57] ABSTRACT

A cylindrical convection heat dissipation tower is shown having a top and bottom cap with wound heat exchange coils dispersed within the tower. Cooling fluid is introduced gradually at the bottom of the tower while warmer cooling fluid is discharged from the top of the tower. The tower utilizes "stacking" principles to gradually lower the temperature of the refrigerant fluids entering at the top of the tower, passing downwardly through the coils, and rising upwardly through an insulated portion of that coil, exiting from the top of the tower.

6 Claims, 6 Drawing Figures

VERTICAL CONVECTION HEAT DISSIPATION TOWER

BACKGROUND OF THE INVENTION

This invention pertains to and is concerned with a vertical convection heat dissipater tower wherein heat exchange coils filled with refrigerant fluid are disposed within the tower. The exchange coils allow a gradual transfer of heat from the refrigerant fluid to a cooling fluid contained within the tower. The tower of this invention is primarily intended for utilization with commercial and residential air conditioning systems, but also has application in heat pumps. The construction arrangement of the tower utilizes the natural heat transfer principle of convection, and specifically, the phenomenon known as "stacking".

DESCRIPTION OF THE PRIOR ART

The applicant is unaware of any closely related patents disclosing a vertical convection heat dissipater tower similar to that of the present invention. However, various heat exchangers or chillers have been known for many years. Typically, such exchangers or chillers are mounted horizontally with cooling fluid entering at one side and discharging from the other side. Structurally, the cooling water flows through a jacket which encases numerous tubes. The tubes contain the fluids sought to be cooled. Other embodiments of heat exchangers utilize a continuously wound tubing configuration. In all of the configurations known, no attempt has been made to utilize the "stacking" phenomenon wherein warmer and lighter fluids rise and cooler and heavier fluids sink. Further, the cooling fluids rates through existing exchangers are not known to be adapted or adjusted to reduce mixing or eddy currents.

The applicant is unaware of any prior art which insulates any portion of the coils or tubes within any existing exchanger to eliminate reheating of the fluid within the tubes as they exit the exchanger.

SUMMARY OF THE INVENTION

A cylindrical housing having a top cap and a bottom cap with helically wound heat exchange coils disposed within the housing makes up the primary structural components of the invention. Cooling fluid, such as water, is slowly introduced into the housing tangentially through the bottom cap. Because of the low flow rate and the tangential introduction, cool water tends to remain at the bottom of the tower while warmer water rises to the top of the tower.

Convection currents result within the tower because every fluid expands when heated, so that a given quantity of fluid increases in volume, and consequently decreases in density. In the convection current, the lighter fluid is pushed up by the heavier surrounding fluid, just as a block of wood under water is pushed to the surface by surrounding water. Thus, a "stack" or gradually increasing temperature gradient is developed from the bottom of the tower to top of the tower. The "stacking" phenomenon is enhanced as hot refrigerant fluid entering the tower through the top cap from, for example, the condenser unit of the conventional air conditioner, passes through the coils. The hot refrigerant fluid first encounters cooling fluid within the tower having a temperature lower than itself. Thus, a heat exchange occurs. As the refrigerant fluid moves down the tower through the coils, it encounters gradually cooler portions of cooling fluid, causing a continuous heat exchange resulting in a gradual cooling of the refrigerant fluid itself.

Upon reaching the bottom of the coil, and at the point of lowest cooling fluid temperature, the refrigerant fluid is also at its lowest temperature. The refrigerant fluid then flows through an insulated, uncoiled portion of the exchange coil, up through the tower, and exits through the top cap at the top of the tower.

The insulated portion of the coil reduces the possibility of heat transfer between the refrigerant fluid and the water or cooling fluid as the refrigerant fluid passes through the warmer temperature portions of the tower.

To reduce the quantity of cooling fluid or water introduced into the tower, a switching means is connected to the valving to shut off cooling fluid when refrigerant is not flowing through the coils. For example, a solenoid valve may be wired into the condenser circuit of the conventional air conditioning system to open the cooling fluid flow line when the compressor is operating.

Alternative embodiments of the invention utilize split-discs to partition the tower into multiple compartments to enhance "stacking" of the temperature gradient. Further embodiments incorporate multiple coil arrangements to increase the heat transfer surface area.

Testing has shown that where the tower height to the tower diameter is maintained within certain proportions, maximum heat transfer occurs.

It is an object of this invention to lower the refrigerant fluid temperature from the compressor of a typical air conditioning system prior to its passing through the evaporator. This lower temperature results in lower evaporator cooling coil temperatures. Further, the lower temperature reduces compressor head pressure thus reducing compressor amperage. These results combine to reduce overall energy consumption and improve system efficiency.

DETAILED DESCRIPTION OF THE PREFERRED EMBODIMENT

Figure 1:
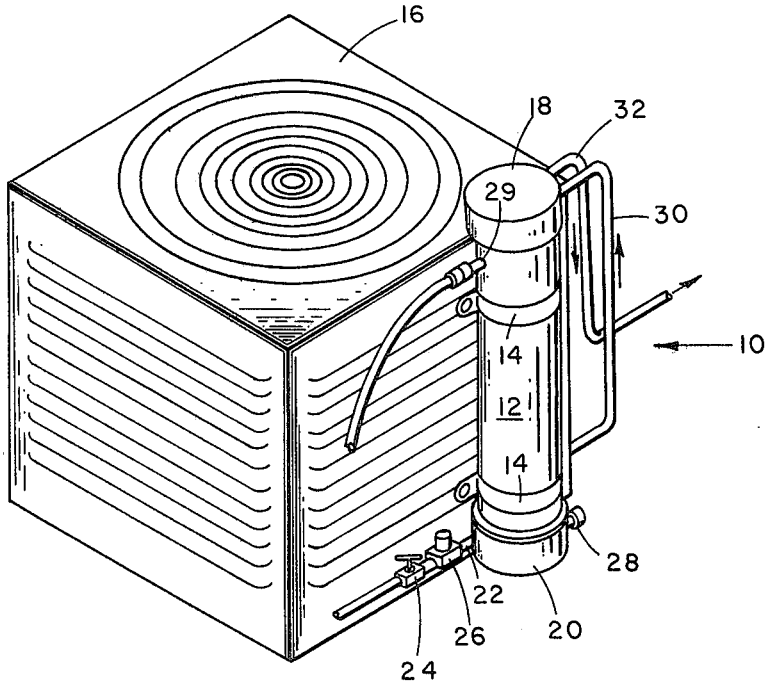
FIG. 1 is a perspective view of the invention attached to the side of the conventional air conditioning unit.

For a detailed description of the preferred embodiment, reference is made to the attached several views wherein identical reference characters will be utilized to refer to identical or equivalent components throughout the various views in the following description.

Referring now to FIG. 1, the vertical convection heat dissipator tower 10 of this invention includes a cylindrical housing 12 attached vertically by suitable connecting means 14 to a condenser 16 of a conventional air conditioning unit (not shown in detail). The cylindrical housing further includes a top cap 18 and a bottom cap 20 secured to the ends of the housing 12.

The tower 10 may be constructed of any suitable material, which may or may not be insulated. The tower 10 and caps 18 and 20 of the preferred embodiment are constructed of polyvinyl chloride tubing to facilitate manufacture, reduce costs, and reduce maintenance.

Entering the bottom cap 20 tangentially is the cooling fluid line 22. In the preferred embodiment, the cooling fluid line 22 would be further connected to a convenient low pressure water supply source. Interposed in the cooling fluid line 22 is a flow rate adjustment valve 24 and an automatic flow control valve 26.

Both the flow rate adjustment valve 24 and the automatic flow control valve 26 are standard in the industry. In the preferred embodiment, the automatic flow control valve 26 is electrically wired to open when the air conditioner condenser circuit is energized.

Flow rate adjustment valve 24 may be sized to accommodate any flow rate to ensure proper operation, but flow rates in the range of one-quarter ($\frac{1}{4}$) gallon per minute to one-half ($\frac{1}{2}$) gallon per minute are typical.

Bottom cap 20 is further adapted with a drain plug 28 to enable the tower to be completely drained of all cooling fluid. The drain plug 28 may be threaded into the bottom cap 20 using standard size plumbing accessories.

The top cap 18 has an opening 34 (see FIG. 3) to receive the refrigerant fluid inlet line 30. In the preferred embodiment, the refrigerant fluid inlet line 30 runs from the outlet side of the condenser 16 in a conventional air conditioning system. Opening 35 in top cap 18 also allows the refrigerant fluid outlet line 32 to pass through the cap 18 on its way to the evaporator portion of a conventional air conditioning system (not shown).

A cooling fluid discharge line 29 is connected to an upper portion of the tower 10. The cooling fluid which flows into the housing 12 and is not evaporated flows out through the cooling fluid discharge line 29 to be recycled or discharged.

While the preferred embodiment calls for the refrigerant fluid inlet and outlet lines 30 and 32 to pass through openings 34 and 35, respectively, in the top cap 18, refrigerant fluid inlet and outlet lines 30 and 32 could pass through any opening in tower 10 located above the cooling fluid discharge line 29.

Figure 2:
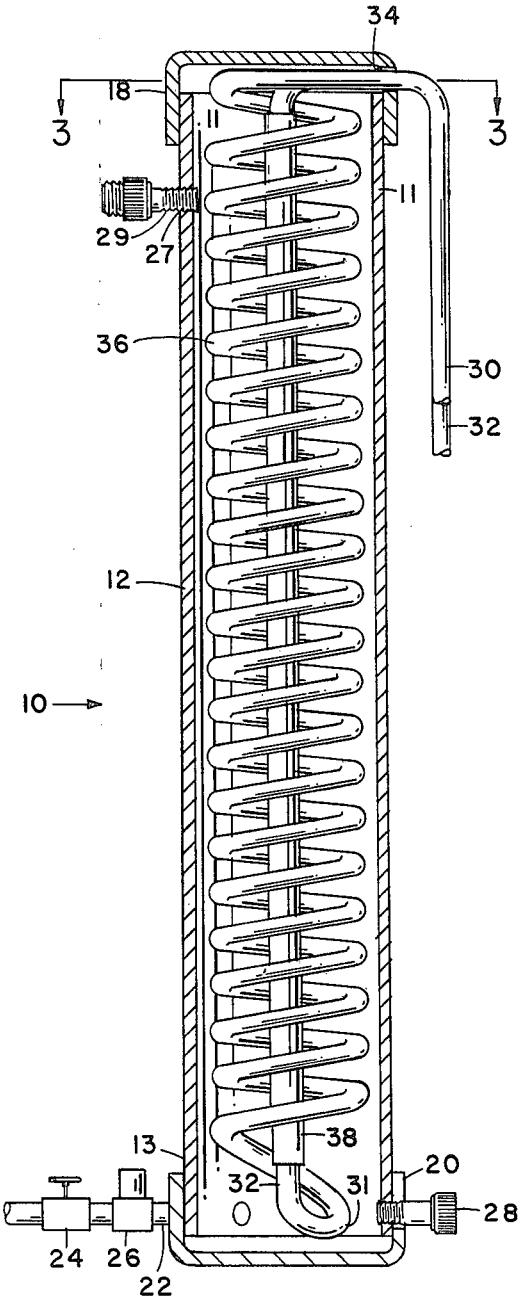
FIG. 2 is an elevated cross-section of the invention.

Viewing FIG. 2, a cross-section of the invention may be seen. Refrigerant fluid inlet line 30 enters the top cap 18 through aperture 34. Refrigerant fluid inlet line 30 in the preferred embodiment is constructed of $\frac{3}{8}''$ copper line coated with acrylic plastic or chrome plated to protect it from oxidation which reduces heat transfer.

Refrigerant fluid inlet line 30 is spirally or helically wound in a relatively tight coil 36 that extends the entire length of the cylindrical housing, 12. In an embodiment utilizing $\frac{3}{8}''$ copper tubing (thin-walled), the coil is wound to have a $3\frac{1}{2}''$ diameter coil measured from center-to-center of the tubing.

At the bottom portion 13 of the cylindrical housing 12, the refrigerant fluid inlet line 30 is twisted by a sharp bend 31 to extend vertically through the center of the coil 36. For the purpose of this description, the refrigerant fluid inlet line 30 is designated from sharp bend 31 as the refrigerant fluid outlet line 32. Refrigerant fluid outlet line 32 is generally insulated from contact with the cooling fluid within the housing 12 by means of an insulating sleeve 38, which extends the length of refrigerant fluid outlet line 32 from near the sharp bend 31 to top portion 11 of the cylindrical housing 12.

Refrigerant fluid outlet line 32 exits the housing 12 via an aperture 35 in top cap 18. Refrigerant fluid outlet line 32 then travels, in the preferred embodiment, to the evaporator portion (not shown) of a conventional air conditioning system. Refrigerant fluid outlet line 32 may be totally insulated along its entire length from the tower 10 to its connection to the evaporator portion so as to eliminate reheating of the refrigerant fluid.

Figure 3:
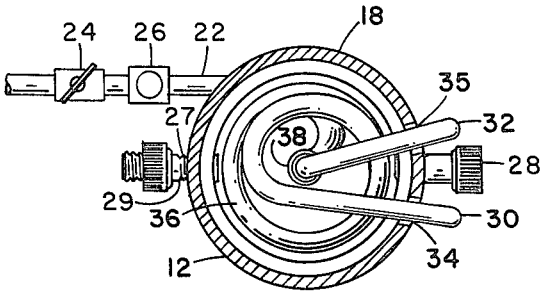
FIG. 3 is a top view of FIG. 2 with the cap removed.

FIG. 3 is a sectional view of FIG. 2 taken along section line 3—3. Refrigerant fluid inlet line 30 passes through openings 34 in top cap 18 and begins to coil down through housing 12. Only wrap of the coil 36 is shown in FIG. 3. Insulating sleeve 38 is shown encasing refrigerant fluid outlet line 32 as it rises upward through the center of the coil 36. Refrigerant fluid outlet line 32 passes through aperture 35 in top cap 18.

Figure 4:
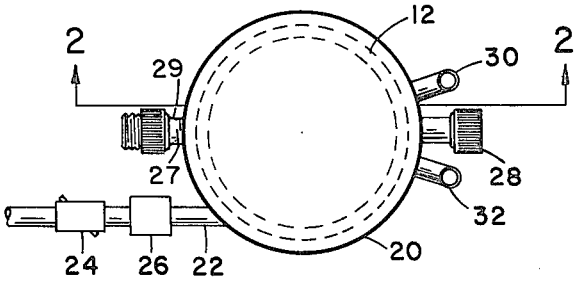
FIG. 4 is a bottom view of FIG. 2.

FIG. 4 is a bottom view of FIG. 2 with the cooling fluid inlet line 22 connected tangentially to bottom cap 20. During operation, cooling fluid (preferably water) is introduced into the housing 12 at low flow rates of approximately $\frac{1}{4}$–$\frac{1}{2}$ gallon per minute. Having cooling fluid inlet line 22 located tangentially allows the cooling fluid to enter the housing without creating significant eddy currents or causing a significant mixing of the cooling fluid.

FIG. 4 further shows the location of the flow rate adjustment valve 24 and the automatic flow control valve 26 along the cooling fluid inlet line 22 flow path.

Viewing FIG. 1, during operation of the preferred embodiment, the invention is filled with water by allowing automatic flow control valve 26 to open. Once the housing is filled with water, the automatic flow control valve is switched over to open only when the condenser unit 16 in the air conditioner system is energized. As hot refrigerant fluids pass through refrigerant fluid inlet line 30 and down through the coil 36, heat is transferred to the cooling fluid within the housing 12. Because of the convection current principle, the water at the top of the housing 12 will be warmer than that at the bottom. Thus, a "stacking" or temperature gradient will develop.

Small amounts of water are introduced tangentially into the housing 12 to ensure that cooler water is allowed to gradually enter the housing 12. As previously stated, the automatic flow control valve 26 only opens to introduce water when the condenser 16 is operating. As cool water is introduced, warm water at the top of the housing 12 flows through cooling fluid discharge line 29 attached through an opening 27 near the top of the housing 12. The water may be discharged or recycled as desired.

Figure 5:
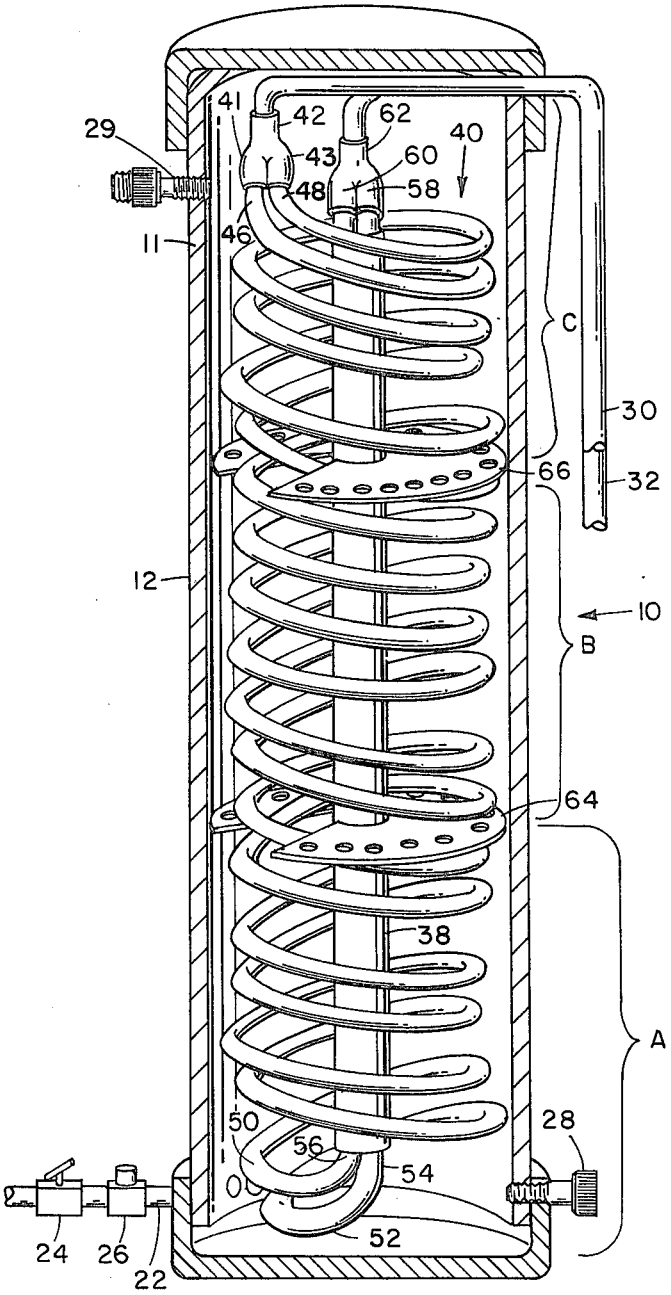
FIG. 5 is an elevated cross-sectional view of an alternative embodiment of the invention.

FIG. 5 shows a perspective view of another embodiment of the invention. Specifically, the embodiment of FIG. 5 illustrates a double coil arrangement 40 wherein refrigerant fluid inlet line 30 is connected to a "Y" adapter 42 with the first branch 41 connected to a first inlet coil tube 46 and the second branch 43 connected to a second inlet coil tube 48.

First inlet coil tube 46 and second inlet coil tube 48 are wound adjacent to one another and extend downwardly through the entire length of the cylindrical housing 12. At the bottom portion of the cylindrical housing 12, first inlet coil tube 46 and second inlet coil tube 48 are twisted by sharp bend 50 and 52, respectively, to extend vertically through the center of the coil arrangement 40. For the purpose of this description, first inlet coil tube 46 and second inlet coil tube 48 are designated from sharp bends 50 and 52, respectively, as first outlet coil tube 54 and second outlet coil tube 56.

First and second outlet coil tubes 54 and 56 are generally insulated from contact with the cooling fluid within the cylindrical housing 12 by means of an insulating sleeve 38, which extends the length of first and second outlet coil tubes 54 and 56 from near the sharp bends 50 and 52 to top portion 11 of cylindrical housing 12.

First and second outlet coil tubes 54 and 56 are connected to first branch 58 and second branch 60, respectively, of Y connector 62, which in turn is connected to refrigerant fluid outlet line 32.

FIG. 5 further shows the placement of two split-disc 64 and 66 within cylindrical housing 12. Discs 64 and 66 are slip-fitted within housing 12 and generally positioned to separate the housing 12 into three separate compartments A, B and C. The discs 64 and 66 serve to further reduce eddy currents and mixing of the coolant fluid within housing 12 during operation at higher flow rates.

Figure 6:
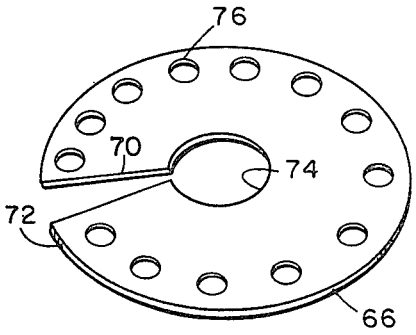
FIG. 6 is a perspective view of a split-disc used in the alternative embodiment of FIG. 5.

Discs 66 and 68 are constructed identically, and a perspective view of disc 66 is shown in FIG. 6. Disc 66 has a split 70 extending from the outer circumference 72 of disc 66 to an inner bore 74 within disc 66. Inner bore 74 is large enough to allow first and second outlet coil tubes 54 and 56 encased by insulating sleeve 38 to pass through disc 66. The split 70 allows disc 66 to twist slightly to accommodate fitting around the coil arrangement 40.

Disc 66 further has multiple bores 76 spaced along the edge of disc 66. These bores allow warmer coolant fluid to rise up through the housing 12 enhancing the "stacking" phenomenon utilized in the present invention and reducing the possibility of eddy currents or mixing.

Testing has shown that the taller and narrower the invention, the more efficient the device. The preferred embodiment of FIG. 2 calls for 4" polyvinyl chloride (PVC) pipe, 30" high, with 4" PVC top and bottom caps. The coil is constructed of $\frac{3}{8}$" copper tubing wound into a $3\frac{1}{2}$" diameter coil. The above stated sizes have been found to satisfactorily serve to improve the operation of air conditioner units up to 5 ton capacity. For air conditioner units above 5 ton capacity, testing has shown that maintaining a height to diameter ratio in inches of 7.5:1 yields the best results. Ratios as low as 4:1 will operate. No upper limit on ratios has been documented.

I claim:

1. A convection heat dissipater comprising:

a. a vertical housing having a top end and a bottom end;

b. a top cap connected to said top end of said vertical housing;

c. a bottom cap connected to said bottom end of said vertical housing;

d. a first fluid tube passing through a first aperture near said top end, said first fluid tube having a coiled portion extending downwardly inside said vertical housing from approximately said top end to said bottom end, said first fluid tube having an insulated portion extending upwardly from approximately said bottom end through said coiled portion to said top end, said first fluid tube exiting said vertical housing through a second aperture near said top end;

e. a second fluid tube connected to a third aperture near said bottom end and in fluid communication with said vertical housing, said second fluid tube being generally tangentially connected to said vertical housing;

f. a discharge port located near said top end of said vertical housing; and g. said convection heat dissipater being adapted to receive a refrigerant fluid from a condenser of an air conditioning system through said first fluid tube, a coolant fluid flowing in through said second fluid tube, into said vertical housing and out through said discharge port.

2. The invention of claim 1 further comprising at least one partitioning means located within as extending generally horizontal in said vertical housing, said partitioning means adapted to allow said first fluid tube to extend through said partitioning means and further adapted to restrict mixing of said coolant fluid within said vertical housing.

3. The invention of claim 2 wherein said second fluid tube further comprises a flow adjustment valve and an automatic flow control valve located along said second fluid tube immediately prior to said third aperture, said automatic control valve being adapted to open when energized by voltage being applied to said condenser in said air conditioning system.

4. The invention of claim 3 wherein said first fluid tube has a plurality of said coil portions.

5. The invention of claim 4 wherein vertical housing is cylindrical tube having a height to diameter ratio of 7.5:1, said flow adjustment valve adjusted to introduce said coolant tangentially into said cylindrical tube at a flow rate between $\frac{1}{4}$ to $\frac{1}{2}$ gallon per minute.

6. A convection heat dissipater comprising:

a. a vertical cylindrical tube having a top end and a bottom end;

b. a top cap connected to said top end of said vertical cylindrical tube;

c. a bottom cap connected to said bottom end of said vertical cylindrical tube;

d. a first fluid tube passing through a first aperture in said top cap, said first fluid tube branching into a plurality of coiled portions, said coiled portions extending downwardly inside said vertical cylindrical tube from approximately said top cap to approximately said bottom cap, said plurality of coiled portions bending sharply and becoming uncoiled portions near said bottom cap, said uncoiled portions extending upwardly through said plurality of coiled portions, said uncoiled portions encased by an insulating sleeve member, said uncoiled portions being coupled to form a single exit fluid tube exiting said vertical cylindrical tube through a second aperture in said top cap;

e. a second fluid tube connected to a third aperture in said bottom cap and in fluid communication with said vertical cylindrical housing, said second fluid tube being tangentially connected to said bottom cap, said second fluid tube having a flow adjustment valve and an automatic flow control valve located along said second fluid tube immediately prior to said third aperture, said automatic control valve being adapted to open when energized by a voltage being applied thereto;

f. a discharge line threaded into a fourth aperture located near said top end of said vertical cylindrical tube;

g. a plurality of semi-rigid, generally horizontal discs equally spaced within and along the entire height of said vertical cylindrical tube, each of said discs having a split extending from the outer circumference of said disc to an inner bore in the center of said disc, each of said discs further having a multiplicity of bores spaced along the circumferential edge of said disc, said inner bore sized to enable said plurality of uncoiled portions of said first fluid tube and said insulating sleeve member to pass through said inner bore;

h. a drain plug threaded into a fifth aperture at the lowest point of said bottom cap; and i. said convection heat dissipater being adapted to receive a refrigerant fluid from a condenser of an air conditioning system through said first fluid tube, a coolant fluid flowing in through said second fluid tube, into said vertical cylindrical tube, through said fourth aperture, and out through said discharge line.

* * * * *